US005575261A

United States Patent [19]

Junger et al.

[11] Patent Number: 5,575,261

[45] Date of Patent: Nov. 19, 1996

[54] FUEL INJECTION PUMP FOR INTERNAL COMBUSTION ENGINES

[75] Inventors: Dieter Junger, Stuttgart; Peter Zweigle, Ditzingen, both of Germany

[73] Assignee: Robert Bosch GmbH, Stuttgart, Germany

[21] Appl. No.: 507,262

[22] Filed: Aug. 18, 1995

[30] Foreign Application Priority Data

Dec. 29, 1993 [DE] Germany ..... 43 44 865.8

[51] Int. Cl.[6] ..... F02M 41/12

[52] U.S. Cl. ..... 123/449; 123/494; 417/500

[58] Field of Search ..... 417/500; 123/494, 123/449

[56] References Cited

U.S. PATENT DOCUMENTS

| | | | |
|---|---|---|---|
| 5,000,668 | 3/1981 | Namura et al. | 123/449 X |
| 5,205,262 | 4/1993 | Anton et al. | 123/494 |
| 5,220,894 | 6/1993 | Straubel | 123/449 |
| 5,357,930 | 10/1994 | Fehlmann | 123/449 |

*Primary Examiner*—Richard E. Gluck
*Attorney, Agent, or Firm*—Edwin E. Greigg; Ronald E. Greigg

[57] ABSTRACT

The invention relates to a fuel injection pump for internal combustion engines with a pump plunger (18), a drive shaft (11) for the actuation of the pump plunger (18) and a rotational-angle sensor (30) for detecting the angular position of the drive shaft (11), the pulse generator of which is designed as a generator wheel (32) seated firmly in terms of rotation on the drive shaft (11) and the pulse pick-up (31) of which is held on a carrier ring (35) seated rotatably on the drive shaft (11). For the purpose of narrowly toleranced exact association of the pulse generator wheel (32) and the pulse pick-up (31) both in the radial and in the axial direction, the pulse pick-up (31) is accommodated in a sensor housing (40) and this housing is fixed positively and frictionally on the carrier ring (35) by means of plug-in elements. Formed on the sensor housing (40) are sliding surfaces (41, 42), which rest on opposite sides of the pulse generator wheel (32), and a stop surface (46) which corresponds in the radial direction to a stop surface on the carrier ring (35) (FIG. 8).

28 Claims, 7 Drawing Sheets

Fig. 2
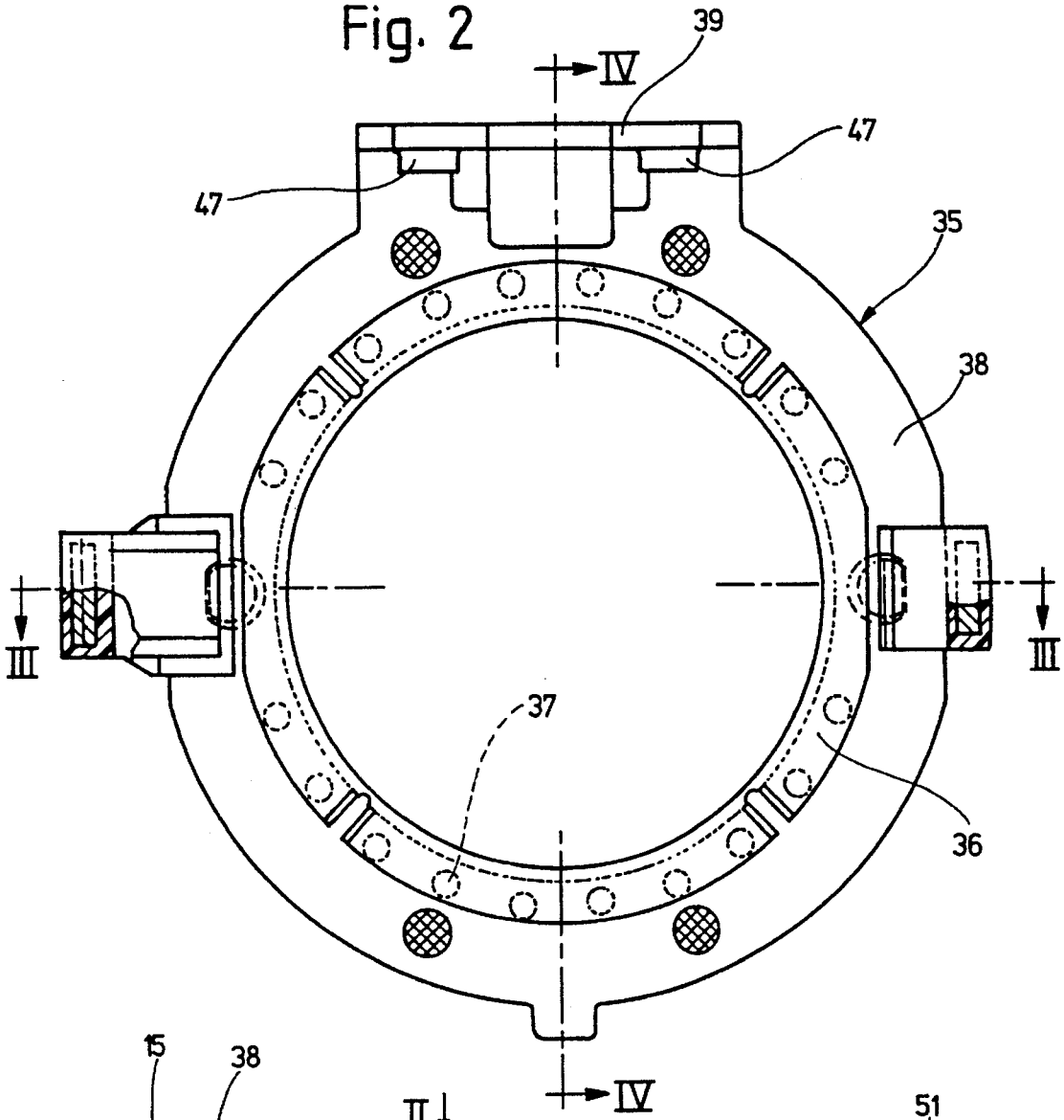
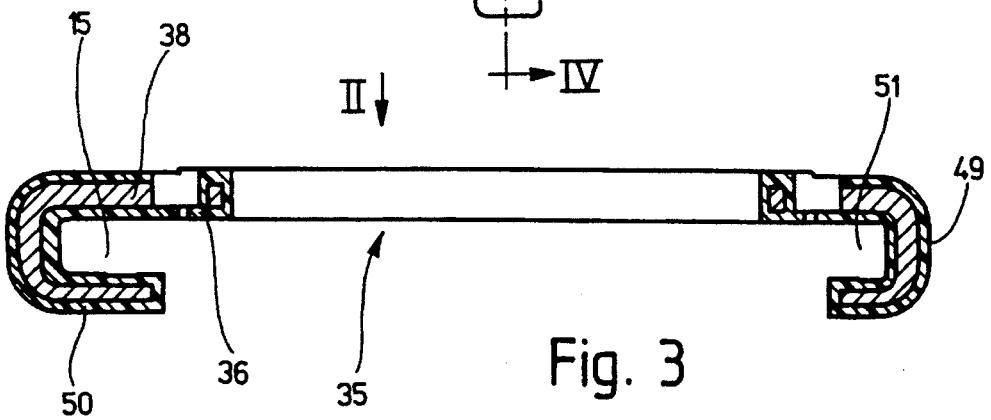
Fig. 3

FUEL INJECTION PUMP FOR INTERNAL COMBUSTION ENGINES

PRIOR ART

The invention starts from a fuel injection pump for internal combustion engines as defined hereinafter.

To avoid effects giving rise to faults in the output signal, to produce a very uniform output signal of the pulse pick-up and to reduce the axial width of the pulse generator wheel to a minimum, the exact radial and axial association of the pulse pick-up and the pulse generator wheel is extremely important in such fuel injection pumps. Particularly in the case of fuel injection pumps of the distributor type in which the carrier ring is secured on the roller ring of a coupling which converts the rotary motion of the drive shaft into a rotary and simultaneously axially reciprocating motion of the pump plunger and is situated between the drive shaft and the pump plunger, the roller ring being fixed or rotatable within limits by an injection adjuster coaxially with the drive shaft axis and its radially aligned rollers rolling on a face cam connected firmly in terms of rotation to the pump plunger, both tilting movements and rotary movements of the carrier ring relative to the pulse generator wheel occur in the absence of a fixed axial association of the carrier ring and the pulse generator wheel. The pulse pick-up, which is secured on the carrier ring, accompanies these movements, which appear as errors in its output signal.

In a known fuel injection pump of the type stated at the outset (WO 91/19899), the axial association of the pulse generator wheel and the carrier ring is achieved by providing that the carrier ring, which is arranged directly adjacent to the pulse generator wheel shrunk onto the drive shaft and is seated rotatably on the drive shaft, has an annular wall which surrounds the pulse generator wheel axially with a radial clearance and from which webs arranged offset around the circumference project radially inwards towards the axis of the generator wheel and press, by means of a respective sliding surface, against that face of the pulse generator wheel which faces away from the carrier ring. The carrier ring itself rests on the other face of the pulse generator wheel by means of a further sliding surface. The pulse pick-up is secured on the annular wall of the carrier ring in such a way that it scans the spacing of the teeth arranged around the circumference of the pulse generator wheel.

ADVANTAGES OF THE INVENTION

The fuel injection pump according to the invention has the advantage that both the radial and the axial association of the pulse pick-up and the pulse generator wheel are produced by a one-piece sensor housing made of plastic into which the pulse pick-up is inserted, preferably with positive engagement. Thus only a single component is involved in the axial association of the carrier ring, the pulse pick-up and the pulse generator wheel, as a result of which the accuracy of association is improved and the production costs are reduced. The shifting of all the association functions into the sensor housing simplifies the production and installation of the carrier ring. The centering of the sensor housing together with the pulse pick-up fixed therein on the carrier ring, which is effected by means of plug-in elements, and the centering of the carrier ring on the pulse generator wheel, which is effected by the sliding surfaces, facilitates assembly both with loose screws and with captive screws.

Advantageous further developments and improvements of the fuel injection pump specified herein are possible by virtue of the measures presented herein.

In an advantageous embodiment of the invention, the carrier ring has a flange which extends axially beyond the pulse generator wheel, and the elements designed as plug-in elements for fixing the sensor housing on the carrier ring comprise tabs, which are preferably arranged on the flange, and pockets, which are preferably arranged on the sensor housing and, in the plugged-in mode of the sensor housing and the flange, fit around and over the tabs, and screw-fastening means for connecting the sensor housing and the flange. One stop surface for the radial association of the pulse pick-up and the pulse generator wheel is formed by the top surface of the flange and the other is formed by a housing shoulder extending transversely to the plug-in direction of the sensor housing. The housing shoulder is integrally formed on the sensor housing in such a way that, in the plugged-in mode of the sensor housing and the flange, it rests against the top surface of the flange and is fixed frictionally by the screw-fastening means.

According to a further embodiment of the invention, the elements for fixing the sensor housing on the carrier ring have two webs, which project outwards from the carrier ring and extend parallel to one another at a distance from one another, two axial grooves which are arranged at opposite ends of the sensor housing and serve to receive the webs, and a snap connection which connects the sensor housing to the webs. In this embodiment of the invention, a high accuracy of association is obtained between the sensor and the pulse generator wheel, since an angular error due to the bending tolerance of the flange, as can occur in the preceding exemplary embodiment, is eliminated. The structural configuration is significantly less expensive to manufacture and the snap connection permits rapid assembly and disassembly in combination with a reliable frictional contact of the sensor housing with the carrier ring even at high speeds, whereby the radial association of the pulse pick-up and the pulse generator wheel is ensured with high accuracy.

In a preferred embodiment of the stop surfaces for the radially highly accurate association of the sensor housing and the carrier ring, one stop surface is formed by the groove base of a transverse groove which extends diametrically in the sensor housing and is made in the underside of the sensor housing, said underside being associated with the carrier ring, and the other stop surface is formed by the top surface of a rib which is formed, preferably integrally, on the carrier ring, extends transversely between the web roots and can enter the transverse groove. The transverse groove and the axial grooves on the sensor housing, on the one hand, and the webs and the rib on the carrier ring, on the other hand, are each arranged in one plane.

According to alternative embodiments of the invention, the snap connection can be embodied by a resilient holding plate which spans the top side of the sensor housing, said top side facing away from the carrier ring, and is snapped in on the webs of the carrier ring, or by latching hooks which are formed on the sensor housing and snapped into corresponding latching holes in the webs of the carrier ring.

In a preferred embodiment of the invention, the sliding surfaces for the axial association of the carrier ring and the pulse generator wheel are arranged on the mutually facing inner surfaces of a U-shaped guide fork which is formed on the sensor housing on its underside, said underside being at the front in the plug-in direction, and which radially overlaps the pulse generator wheel in the plugged-in mode of the sensor housing and the flange.

BRIEF DESCRIPTION OF THE DRAWINGS

The invention is explained in greater detail in the following description with reference to exemplary embodiments depicted in the drawing, in which:

FIG. 2 shows a plan view of a carrier ring partly in section of the rotary angle sensor of the fuel injection pump in accordance with FIG. 1, on an enlarged scale, FIG. 3 shows a section through the carrier ring of FIG. 2 along the line III—III in FIG. 2.

DETAILED DESCRIPTION OF THE EXEMPLARY EMBODIMENTS

Figure 1:
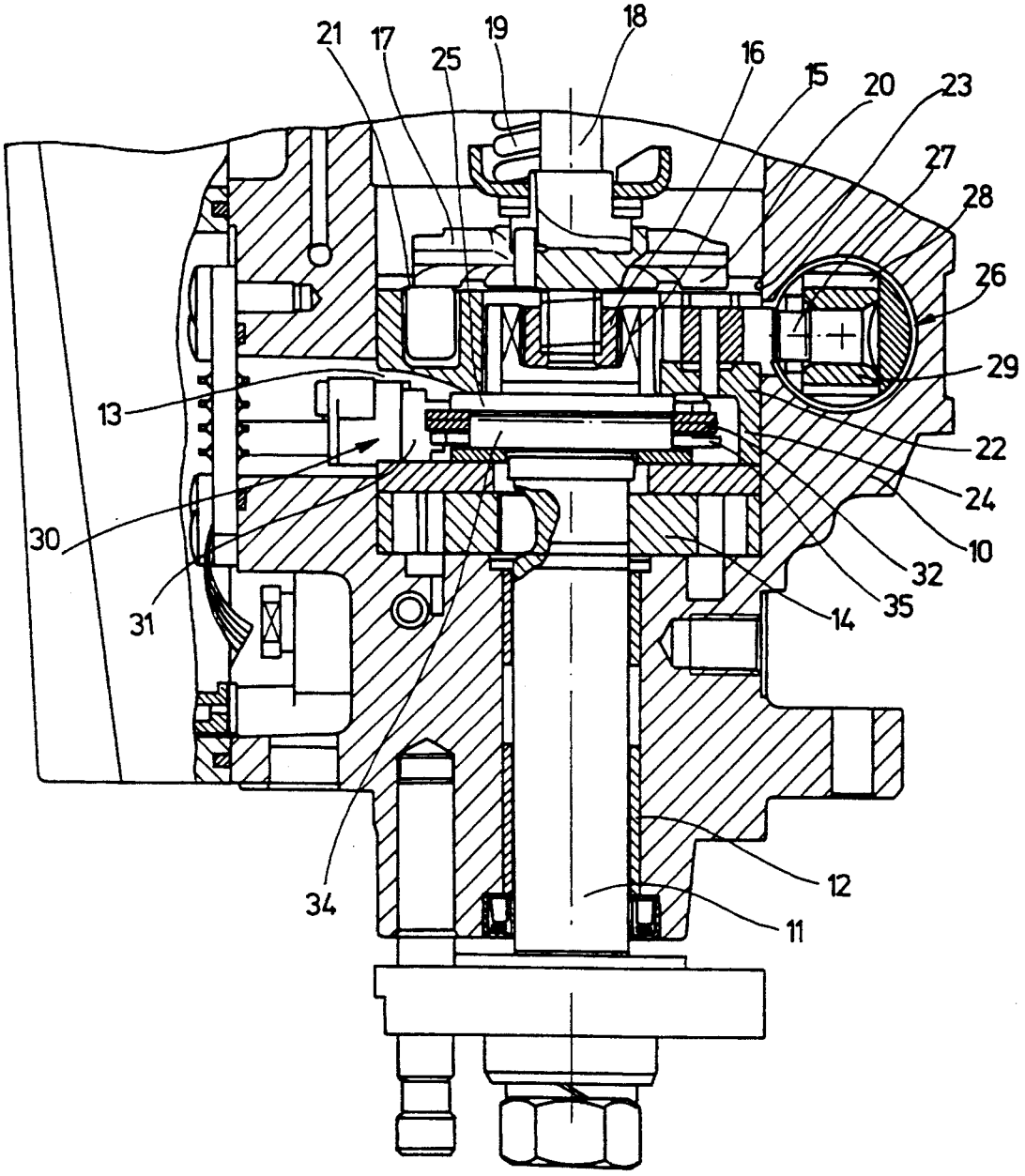
FIG. 1 shows a detail of a partial longitudinal section through the longitudinal axis of a distributor-type fuel injection pump for an internal combustion engine, with a rotary angle sensor shown partly in section and shown on a larger scale in FIG. 8.

The distributor-type fuel injection pump for internal combustion engines which is depicted partially in axial longitudinal section in FIG. 1 has a pump casing 10 in which a drive shaft 11 is rotatably mounted by means of sliding-contact bearings 12. In its interior, the pump casing 10 encloses a pump interior space 13 which is filled with pressurized fuel. The pump interior space 13 is filled with the aid of a feed pump 14 which is arranged in the pump interior space 13 and is driven by the drive shaft 11. At the end of-the drive shaft 11 there is, on the end face, a pair of dogs 15 which, by way of a drive piece 16 and corresponding dogs (not shown), drives a face cam 17 in rotation. A pump plunger 18 is coupled firmly in terms of rotation to the face cam 17, this being known, and the said pump plunger is pressed against the face cam 17 by a spring 19 and presses a cam track 20 arranged on the face cam 17 against rollers 21 mounted in a radial orientation in a roller ring 22. The latter is supported rotatably by its circular outer contour in a corresponding circular-cylindrical recess 23 in the pump interior space 13 and is supported axially by way of a skirt 24 on a disk 25 covering the feed pump 14. The coupling, formed by the pair of dogs 15 and the driver piece 16, between the drive shaft 11 and the pump plunger 18 projects through the roller ring 22. The roller ring 22 is mounted in such a way as to be rotatable within limits in the circumferential direction and is actuated in a known manner by an injection adjuster 26. For this purpose, the roller ring 22 is coupled to an injection adjuster piston 28 by a pin 27 extending radially with respect to the drive shaft 11. Coupling is here generally effected by way of a sliding block 29.

To detect the angular position of the drive shaft 11, a rotational-angle sensor 30 is provided in the pump interior space 13, the said rotational-angle sensor comprising in a known manner a pulse generator revolving in synchronism with the drive shaft 11 and a pulse pick-up 31 fixed relative to said generator. The pulse generator is designed as a pulse generator wheel 32 with external toothing 33 (FIG. 8), the pulse pick-up 31, which is aligned radially with respect to the pulse generator wheel 32, scanning the external toothing 33 and producing a corresponding rotational-angle signal. The pulse generator wheel 32 is mounted in a manner fixed in terms of rotation on a collar 34 of enlarged diameter of the drive shaft 11, preferably by press-fitting, while the pulse pick-up 31 is held on a carrier ring 35 which is mounted directly adjacent to the pulse generator wheel 32, likewise on the collar 34 of the drive shaft 11, but, in contrast to the pulse generator wheel 32, can rotate on the collar 34. The carrier ring 35 is coupled with a small amount of play to the roller ring 22 by means of a radial driver (not visible) which projects into the skirt 24 of the roller ring 22. The radial driver is arranged in such a way that it engages in the parallel guide of the roller ring 22 (i.e. into the plane of the drawing in FIG. 1), said guide extending perpendicularly to the pin 27.

Figure 4:
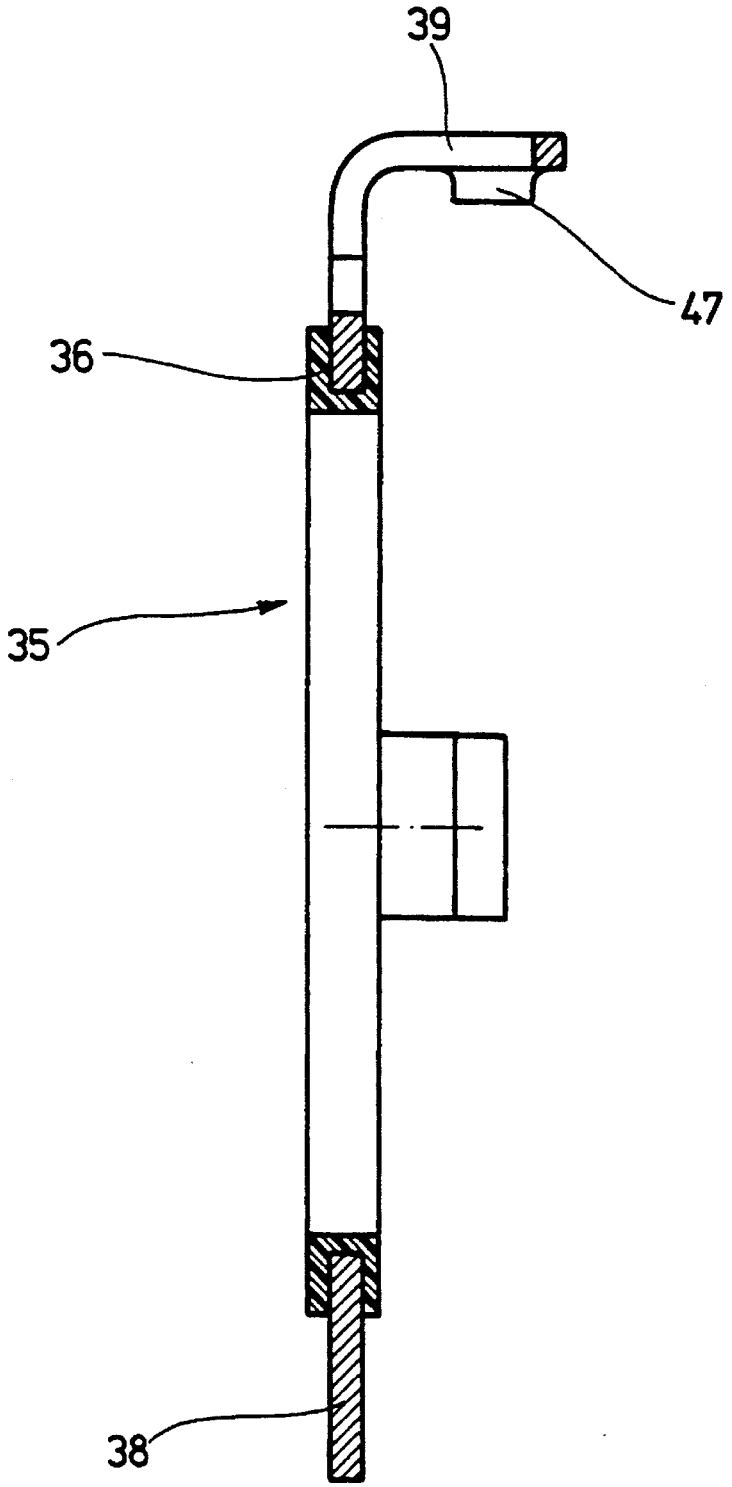
FIG. 4 shows a cross sectional section through the carrier ring in FIG. 2 taken along a section IV—IV.
Figure 5:
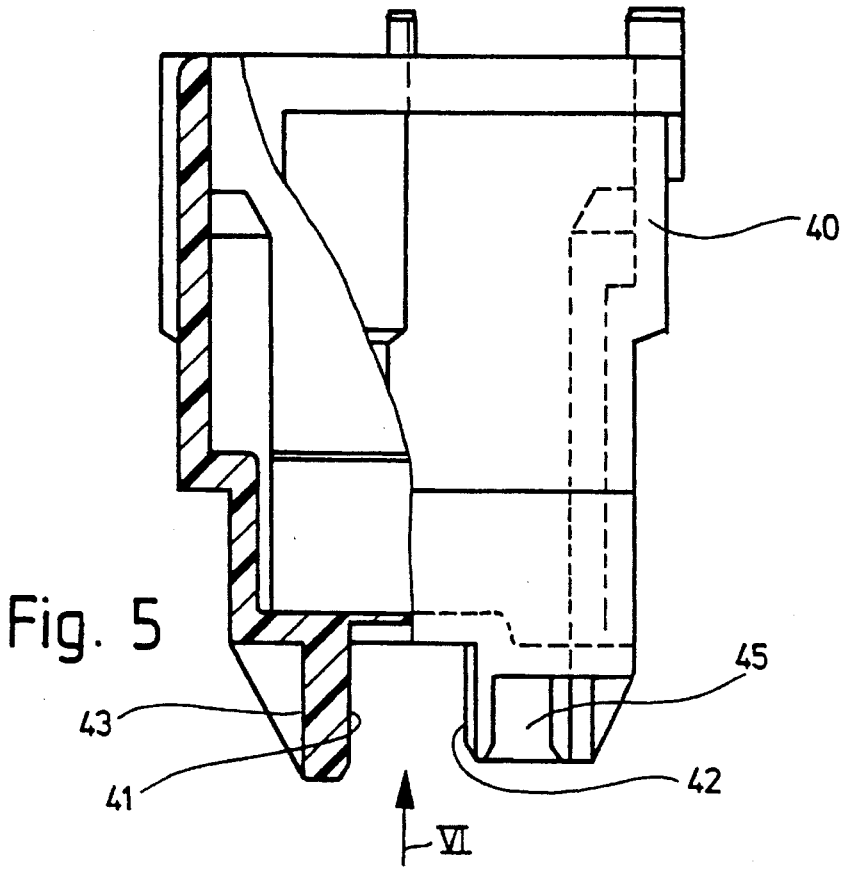
FIG. 5 is an end view of a sensor housing, shown partly in section along the line V—V in FIG. 6, for a pulse pickup of the rotary angle sensor for mounting on the carrier ring of FIGS. 1–4.
Figure 6:
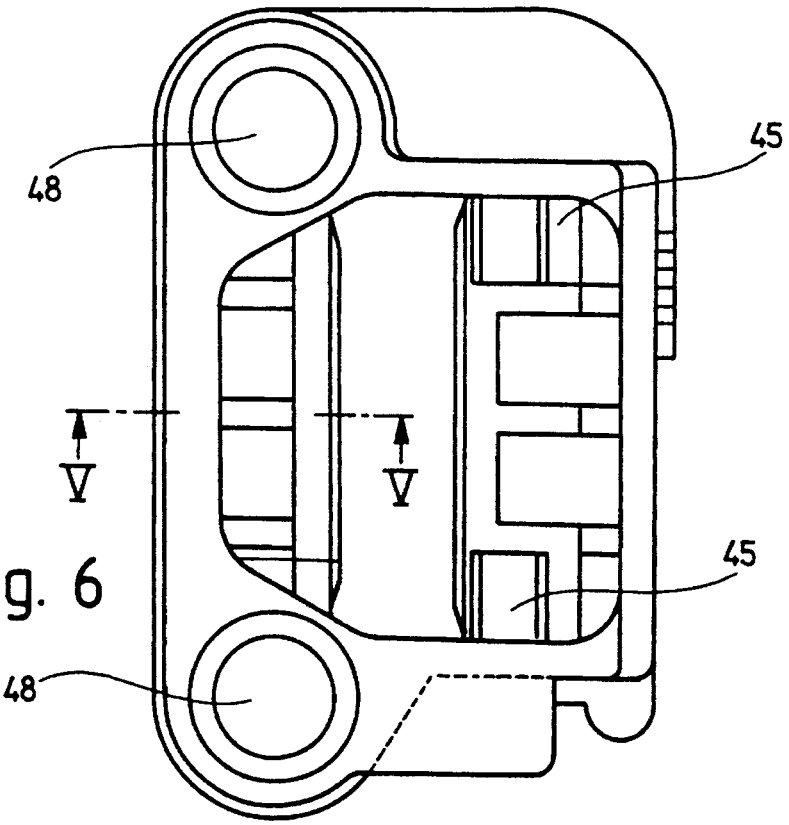
FIG. 6 shows an end view of the sensor housing in the direction indicated by arrow VI in FIG. 5.
Figure 7:
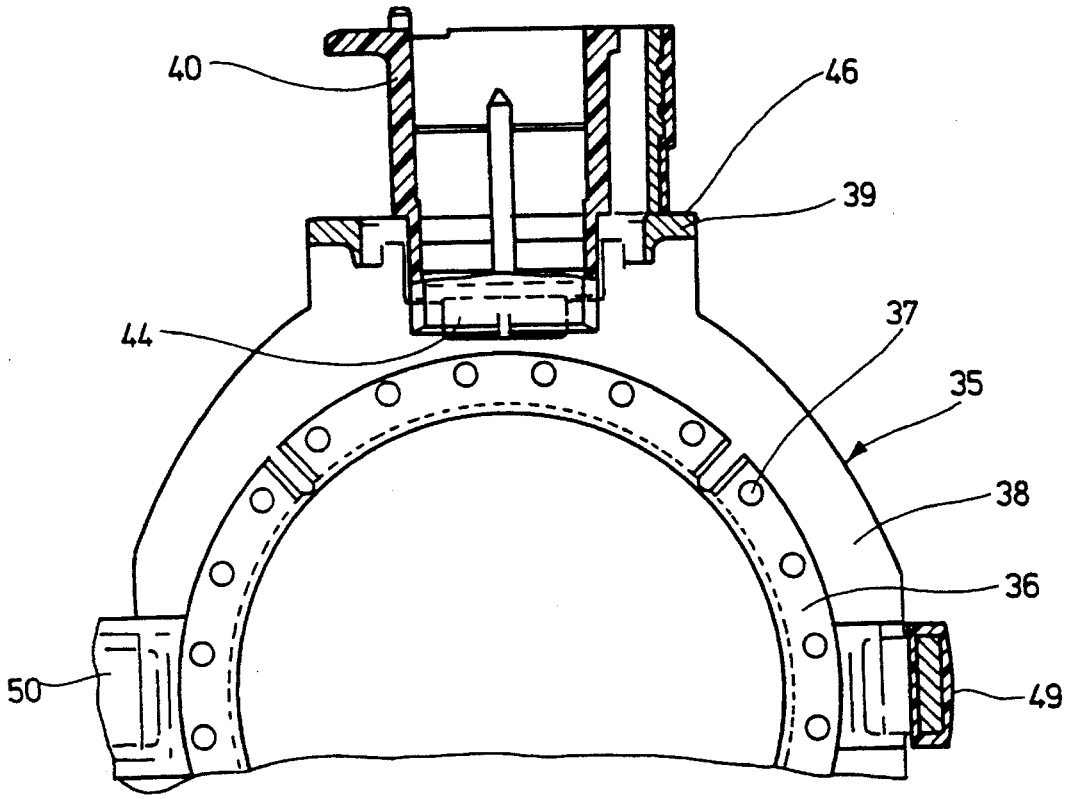
FIG. 7 is a plan view of a portion of the carrier ring in the direction VII of FIG. 8, shown partly in section and with the sensor housing in section and mounted on the carrier ring.
Figure 8:
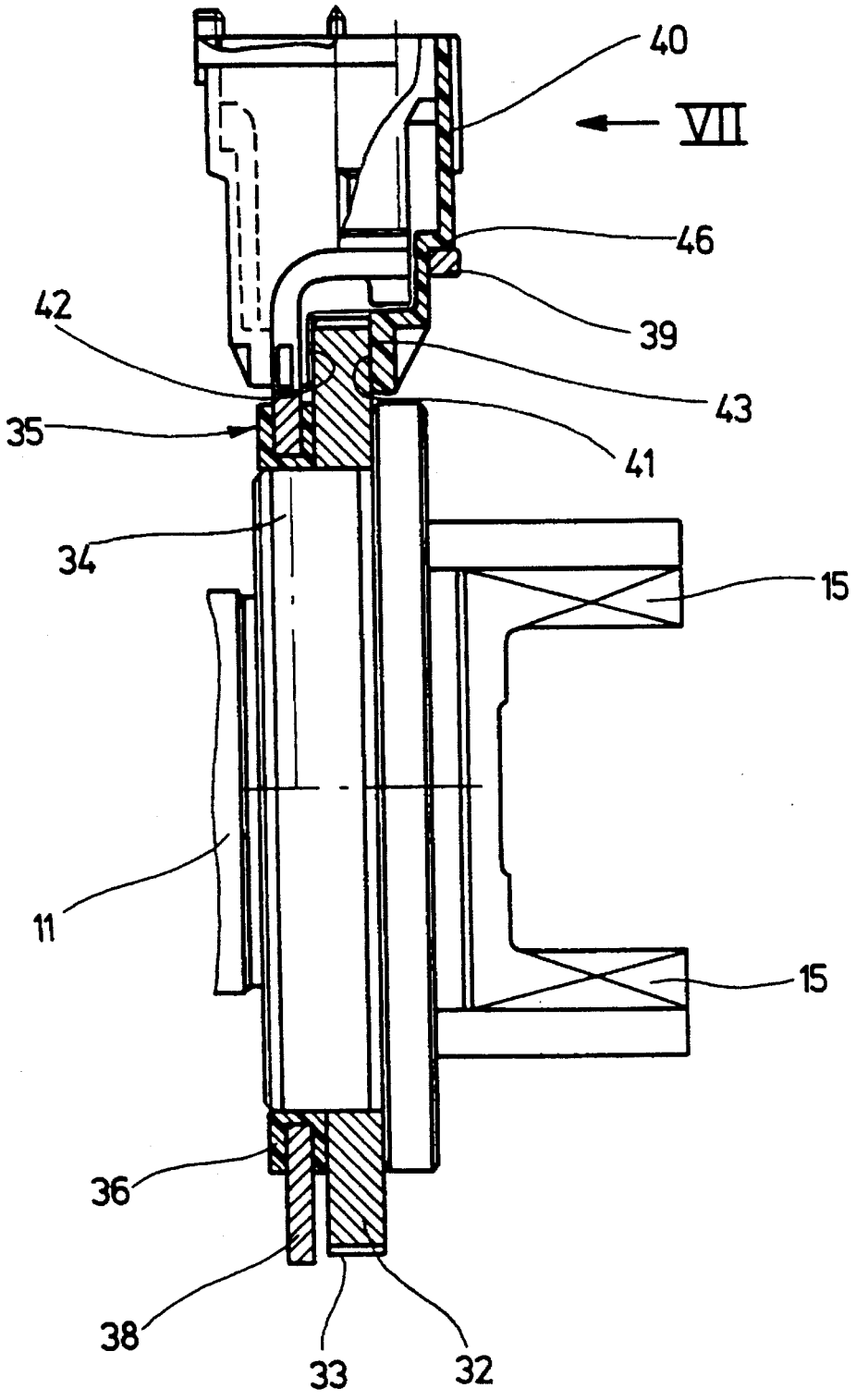
FIG. 8 shows the carrier ring, installed in the fuel injection pump, in a sectional view corresponding to FIG. 1 but on a larger scale, with the sensor housing mounted in place and shown partly in section.

As can be seen from FIGS. 2, 3 and 4, the carrier ring 35 has an annular supporting disk 38, formed integrally on which is an axial flange 39 which projects beyond the pulse generator wheel 32. Also formed on the supporting disk 38 are two tabs 49 and 50 which reach around the pulse generator wheel 32. At its inner annular rim, the supporting disk 38 is encapsulated in plastic in the form of a bush 36 which is seated in sliding fashion on the collar 34 of the drive shaft 11. The plastic encapsulation surrounds the supporting disk 38 at a plurality of apertures 37 which are distributed uniformly around the circumference and are arranged at a short distance from the inner annular rim. This and the intimate connection of the plastic bush 36 with the inner annular rim of the supporting disk 38 ensures that the change in shape and dimensions which would arise from the difference in thermal expansion is small. The tabs 49 and 50 are enclosed in plastic in such a way that an interspace 51 for the axial guidance of the carrier ring 35 on the pulse generator wheel 32 is formed between the mutually facing faces of the tabs 49 and 50 and the plastic bush 36. The pulse pick-up 31 is accommodated in a one-piece sensor housing 40 manufactured from plastic, which is depicted on an enlarged scale in FIGS. 5 and 6. The pulse pick-up 31 is here inserted with positive engagement into the sensor housing 40, thus ensuring firm, narrowly toleranced defined arrangement of the pulse pick-up 31 in the sensor housing 40. To produce a uniform output signal of the pulse pick-up 31 and to avoid falsifying signal influences, exact association of the pulse generator wheel 32 and the pulse pick-up 31 both in the axial and in the radial orientation is of considerable importance. To achieve this, both a narrowly toleranced radial association of the sensor housing 40 with the pulse generator wheel 32 and a narrowly toleranced axial association of the pulse generator wheel 32 and the carrier wheel 35 are effected by means of the sensor housing 40. For this purpose, there are, on the one hand, corresponding plug-in elements on the sensor housing 40 and on the supporting disk 38 of the carrier ring 35 for the positive plug-in reception of the sensor housing 40 on the flange 39 and, on the other hand, sliding surfaces 41, 42 are provided on the sensor housing, said sliding surfaces resting against the pulse generator wheel 32 on both sides of the latter and preventing potential tilting movements of the carrier ring 35, caused by axial movements or accelerations of the drive, in the region of the pulse pick-up 31. The sliding surfaces 41, 42 are formed by the mutually opposite inner surfaces of a guide fork—approximately U-shaped in axial section—which is formed on the sensor housing 40 on its underside, situated at the front in the plug-in direction. In the plugged-in mode of the sensor housing 40 and the flange 39, this guide fork 43 overlaps the pulse generator wheel 32 radially, as can be seen in FIG. 8. The plug-in elements mentioned, for the plug-in reception of the sensor housing 40 on the flange 39, comprise tabs 44 (FIG. 7), which are formed on the supporting disk 38 of the carrier ring 35, and pockets 45 (FIGS. 5 and 6), which are formed on the underside (the latter being situated at the front in the plug-in direction), adjacent to the guide fork 43. In the plugged-in mode—shown in FIGS. 7 and 8—of the sensor housing 40 and the flange 39, the pockets 45 fit around and/or over the tabs 44.

For the radial narrowly toleranced association of the pulse generator wheel 32 and the pulse pick-up 31, the sensor housing 40 has provided on it a stop surface 46, which is formed by a housing shoulder extending transversely to the plug-in direction of the sensor housing 40. This stop surface 46 rests against the flange top surface 391—the latter being at the front in the plug-in direction—of the flange 39 and thus determines the radial distance of the pulse pick-up 31 accommodated with positive engagement in the sensor housing 40 from the external toothing 33 of the impulse generator wheel 32. After being plugged in, the sensor housing 40 is screwed to the flange 39, for which purpose corresponding receiving threads 47 (FIG. 4) are provided on the flange 39 and through holes 48 (FIG. 6) for the passage of screws are provided on the sensor housing 40.

Figure 9:
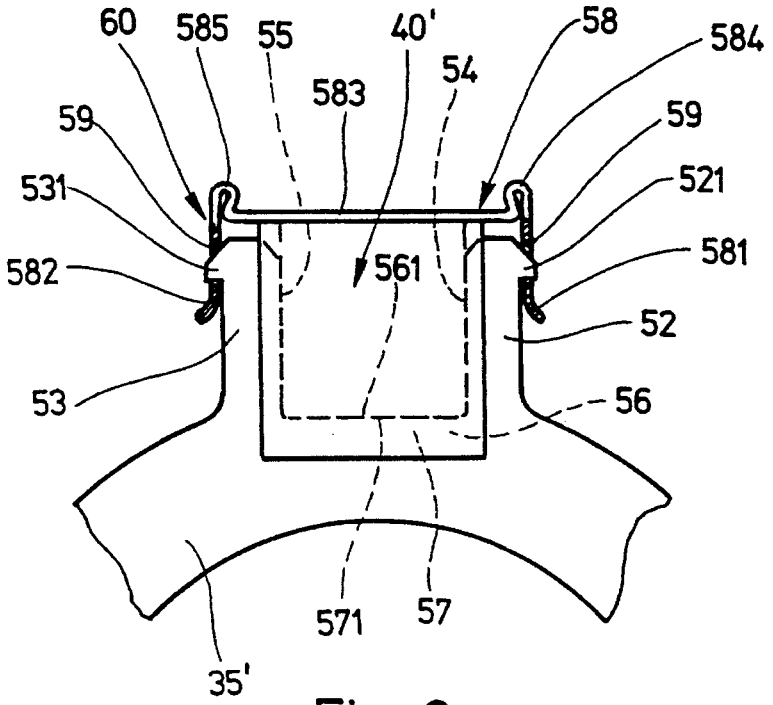
FIG. 9 is a view of a variant way of securing a sensor housing to the carrier ring, in a modification of the view of FIG. 7.

In the case of the carrier ring 35' with the sensor housing 40' mounted on it shown in a partial plan view in FIG. 9, the plug-in elements have, for the purpose of fixing the sensor housing 40' on the carrier ring 35', two webs 52, 53 projecting outwards from the carrier ring 35' and two axial grooves 54, 55 arranged on opposite walls of the sensor housing 40'. The webs 52, 53 extend parallel to one another at a distance from one another and are matched to the axial grooves 54, 55 in such a way that they can enter these essentially in a positive manner. A rib 56 is formed on the carrier ring 35' between the web roots of the webs 52, 53 and a diametrically extending transverse groove 57 is made in the underside of the sensor housing 40', this underside facing the carrier ring 35'. The rib 56 and the transverse groove 57 are matched to one another in such a way that the rib 56 can penetrate into the transverse groove 57. With the transverse groove 57, the axial grooves 54 and 55 lie in a plane extending transversely to the axis of the carrier ring 35', as do the rib 56 and the webs 52, 53 on the carrier ring 35'. As the sensor housing 40 is pushed between the webs 52, 53, the transverse groove 57 is pushed over the rib 56 at the end of the push-in movement until the groove base of the transverse groove 57 strikes the top surface of the rib 56. By means of these two stop surfaces formed by the rib 56 and the transverse groove 57, the radially highly accurate association of the sensor housing 40' with the carrier ring 35' and hence the radial association of the pulse pick-up with the pulse generator wheel is in turn ensured.

For the frictional fixing of the sensor housing 40' on the carrier ring 35', in particular by way of the two stop surfaces formed by the top surface of the rib 56 and the groove base of the transverse groove 57, a snap connection 60 is provided which locks the sensor housing 40' on the carrier ring 35'. In the exemplary embodiment of FIG. 9, the snap connection 60 has an approximately U-shaped holding plate 58 made of spring steel which, with its two U legs 581, 582, fits over the webs 52, 53 on their outer sides, which face away from one another, and with its web 583 spans the top side of the sensor housing 40', said top side facing away from the carrier ring 35'. The transitions from the web 583 to the two U legs 581, 582 are designed as bead-like humps 584, 585 which project above the web 583 of the holding plate 58 on the side facing away from the U legs 581, 582. These humps 584, 585 serve as an engagement surface for the locking and unlocking of the snap connection 60. A rectangular opening 59 is made in each of the two U legs 581, 582 and this opening is capable of fitting over a latching nose 521 and 531, respectively, formed integrally on their outer sides, which face away from one another. The holding plate 58 is advantageously preinstalled on the sensor housing 40' by means of a predominantly positive connection and serves at the same time as a sensor-housing cover and as a conductor-foil guide. To activate the snap connection 60, the bent free ends of the U legs 581, 582 slide over the latching noses 521, 531 while the sensor housing 40' is being inserted between the webs 52, 53 on the carrier ring 35'. Due to pressure on the two humps 584, 585, the two openings 59 in the U legs 581, 582 are pushed over the latching noses 521, 531 and lock the holding plate 58, the web 583 of the latter pressing the sensor housing 40' into frictional engagement with the top surface of the rib 56 on the carrier ring 35'. The prestressing force of the holding plate 58 prevents the sensor housing 40' from rising from the top surface of the rib 56, even in the case of radial acceleration forces acting on the sensor housing 40' during operation. The disassembly of the snap connection 60 is accomplished by pressing on the humps 584, 585 while at the same time pressing sideways in opposite directions on these humps 584, 585.

Figure 10:
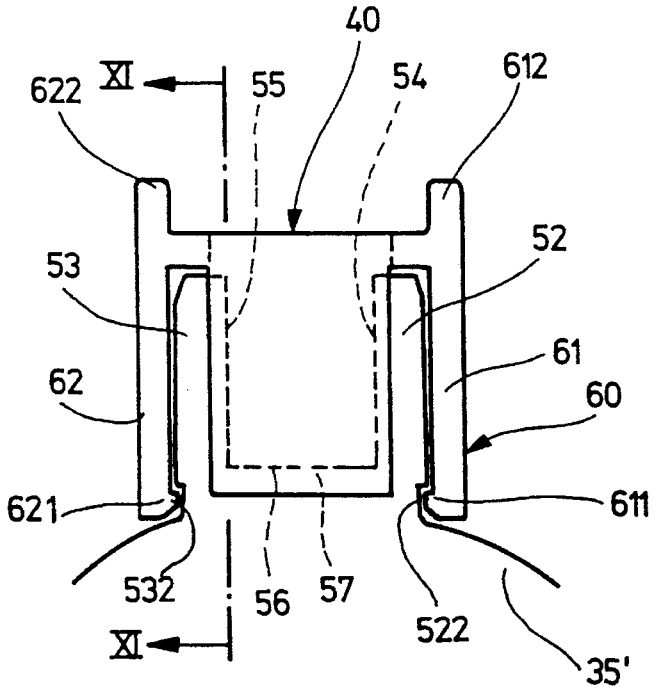
FIG. 10 shows a second variant way of securing the sensor housing on the carrier ring.
Figure 11:
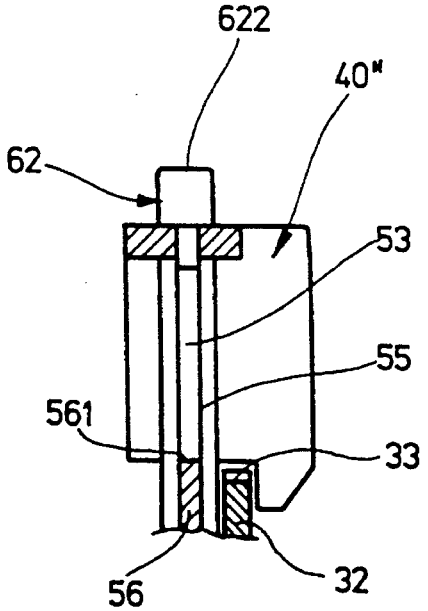
FIG. 11 is a section taken along the line XI—XI of FIG. 10.

The exemplary embodiments of the sensor housing 40" and the carrier ring 35" depicted in FIGS. 10 and 11 differs from the exemplary embodiment described with reference to FIG. 9 only in a different structural embodiment of the snap connection 60. Here, the snap connection 60 has two snap hooks 61, 62, which are attached to the sensor housing 40", fit over the webs 52, 53 on the carrier ring 35" on their outer sides, which face away from one another, and have latching projections 611, 621 formed integrally on the ends of the snap hooks 61, 62, and two recesses 522, 532, formed in the web roots of the webs (52, 53 on their outer sides, which face away from one another, to allow the snap hooks 61, 62 to snap in with their latching projections 611, 621. For the purpose of locking and unlocking the snap connection 60, rear extensions 612, 622 are integrally formed on the snap hooks 61, 62, said extensions extending axially relative to the snap hooks 61, 62 and projecting above the top side of the sensor housing 40", said top side facing away from the carrier ring 35". The snap hooks 61, 62 can be snapped into the recesses 522, 532 of the webs 52, 53 by pressure on the extensions 612, 622. Disassembly of the snap connection 60' is accomplished by pressing on the extension 612, 622 while at the same time pressing sideways in the opposite direction on the extension 612, 622.

The foregoing relates to preferred exemplary embodiments of the invention, it being understood that other variants of embodiment thereof are possible within the spirit and scope of the invention, the latter being defined by the appended claims.

We claim:

1. A fuel injection pump for internal combustion engines, comprising a pump casing (10), with a pump plunger (18) which is accommodated in the pump casing (10) and serves to produce an injection pressure, a drive shaft (11) which is rotatably mounted in the pump casing (10) and serves for the actuation of the pump plunger (18), a rotational-angle sensor (30) which is integrated into the pump casing (10), said rotational-angle sensor (30) comprises a rotating pulse generator and a pulse pick-up (31) fixed relative to the pulse generator and serves for detection of an angular position of the drive shaft (11), the pulse generator is designed as a pulse generator wheel (32) with external toothing (33) seated in a manner fixed in terms of rotation on the drive shaft (11) and the pulse pick-up (31) of which is held in radial association with the external toothing (33) of the pulse generator wheel (32) on a carrier ring (35; 35') seated rotatably on the drive shaft (11) and situated directly adjacent to the pulse generator wheel (32), and sliding surfaces (41, 41) resting on both sides of the pulse generator wheel (32) and serving the purpose of axial narrowly toleranced association of the pulse generator wheel (32) and the carrier ring (35; 35') wherein the pulse pick-up (31) is accommodated, with positive engagement, in a sensor housing (40; 40'; 40") on the carrier ring (35; 35'), wherein the sliding surfaces (41, 42) are formed on the sensor housing (40; 40'; 40") and wherein one of two stop surfaces corresponding to one another in the radial direction is in each case provided on the sensor housing (40; 40'; 40") and on the carrier ring (35; 35') for the radial association of the pulse pick-up (31) and the pulse generator wheel (32).

2. The injection pump as claimed in claim 1, wherein the carrier ring (35) has a flange (39) which extends axially beyond the pulse generator wheel (32), wherein the elements for fixing the sensor housing (40) on the carrier ring (35) have tabs (44) designed as plug-in elements, pockets (45) which fit around and over the tabs (44), and screw-fastening means, the tabs (44) preferably being arranged on the flange (39) of the carrier ring (35) and the pockets (45) preferably being arranged on the sensor housing (40), and the screw-fastening means comprising a through-hole (48), made in the sensor housing (40), for pushing through a screw, and a receiving thread (37) arranged in the flange (39) to allow the sensor housing to be screwed tight.

3. The injection pump as claimed in claim 2, wherein one stop surface is formed by the flange top surface (391) and the other stop surface is formed by a housing shoulder (46) integrally formed on the sensor housing (40) and extending transversely to the plug-in direction of the latter.

4. The injection pump as claimed in claim 1, wherein the elements for fixing the sensor housing (40; 40') on the carrier ring (35') have two webs (52, 53), which project outwards from the carrier ring (35') and extend parallel to one another at a distance from one another, two axial grooves (54, 55) which are arranged on opposite walls of the sensor housing (40'; 40") and serve to receive the webs (52, 53), and a snap connection (60) which connects the sensor housing (40'; 40") to the webs (52, 53).

5. The injection pump as claimed in claim 4, wherein one stop surface is formed by the groove base (571) of a diametrically extending transverse groove (57) made in the underside of the sensor housing (40'; 40"), said underside facing the carrier ring (35'), and the other stop surface is formed by the top surface (561) of a rib (56) which is formed, integrally, on the carrier ring (35'), extends transversely between the web roots and can enter the transverse groove (57).

6. The injection pump as claimed in claim 5, wherein the transverse groove (57) and the axial grooves (54, 55) on the sensor housing (40'; 40"), on the one hand, and the webs (52, 53) and the rib (56) on the carrier ring (35'), on the other hand, are each arranged in one plane.

7. The injection pump as claimed in claim 4, wherein the snap connection (60) has an approximately U-shaped holding plate (58) which fits over the sensor housing (40') on its topside, which faces away from the carrier ring (35'), and, with its U legs (581, 582) fits axially over the webs (52, 53) on their outer sides, which face away from one another, and has latching elements which are formed on the U legs (581, 582) of the holding plate (58) and on the webs (52, 53) and interlock with one another.

8. The injection pump as claimed in claim 5, wherein the snap connection (60) has an approximately U-shaped holding plate (58) which fits over the sensor housing (40') on its topside, which faces away from the carrier ring (35'), and, with its U legs (581, 582) fits axially over the webs (52, 53) on their outer sides, which face away from one another, and has latching elements which are formed on the U legs (581, 582) of the holding plate (58) and on the webs (52, 53) and interlock with one another.

9. The injection pump as claimed in claim 6, wherein the snap connection (60) has an approximately U-shaped holding plate (58) which fits over the sensor housing (40') on its topside, which faces away from the carrier ring (35'), and, with its U legs (581, 582) fits axially over the webs (52, 53) on their outer sides, which face away from one another, and has latching elements which are formed on the U legs (581, 582) of the holding plate (58) and on the webs (52, 53) and interlock with one another.

10. The injection pump as claimed in claim 7, wherein the latching elements comprise outward-projecting latching noses (521, 531) formed integrally on the webs (52, 53) and openings (59) punched in the U legs (581, 582) of the holding plate (58).

11. The injection pump as claimed in claim 7, wherein the transitions from the web (583) of the holding plate (58) to the U legs (581, 582) of the holding plate (58) are designed as bead-like humps (584, 585) which rise above the web (583).

12. The injection pump as claimed in claim 10, wherein the transitions from the web (583) of the holding plate (58) to the U legs (581, 582) of the holding plate (58) are designed as bead-like humps (584, 585) which rise above the web (583).

13. The injection pump as claimed in claim 4, wherein the snap connection (60) has snap hooks (61, 62), wherein are attached to the sensor housing (40") and fit over the webs (52, 53) on their outer sides, which face away from one another, and recesses (522, 532), formed in the webs (52, 53) close to the web roots, for the engagement of latching projections (611, 621) formed on the snap hooks (52, 53).

14. The injection pump as claimed in claim 5, wherein the snap connection (60) has snap hooks (61, 62), wherein are attached to the sensor housing (40") and fit over the webs (52, 53) on their outer sides, which face away from one another, and recesses (522, 532), formed in the webs (52, 53) close to the web roots, for the engagement of latching projections (611, 621) formed on the snap hooks (52, 53).

15. The injection pump as claimed in claim 6, wherein the snap connection (60) has snap hooks (61, 62), wherein are attached to the sensor housing (40") and fit over the webs (52, 53) on their outer sides, which face away from one another, and recesses (522, 532), formed in the webs (52, 53) close to the web roots, for the engagement of latching projections (611, 621) formed on the snap hooks (52, 53).

16. The injection pump as claimed in claim 13, wherein the snap hooks (61, 62) formed integrally on the sensor housing (40") extend at a distance from the sensor housing (40") and parallel to its housing axis and project with respective rear extensions (612, 622) extending axially relative to the associated snap hook (61, 62) above the top side of the sensor housing (40"), said top side facing away from the carrier ring (35').

17. The injection pump as claimed in claim 1, wherein a guide fork (43) which is approximately U-shaped in axial section is formed on the sensor housing (40) on its underside, which faces the carrier ring (35), this guide fork radially overlapping the pulse generator wheel (32) when the sensor housing (40) is fixed on the carrier ring (35), and wherein the sliding surfaces (41, 42) are arranged on the mutually facing inner surfaces of the guide fork (43).

18. The injection pump as claimed in claim 2, wherein a guide fork (43) which is approximately U-shaped in axial section is formed on the sensor housing (40) on its underside, which faces the carrier ring (35), this guide fork radially overlapping the pulse generator wheel (32) when the sensor housing (40) is fixed on the carrier ring (35), and wherein the sliding surfaces (41, 42) are arranged on the mutually facing inner surfaces of the guide fork (43).

19. The injection pump as claimed in claim 3, wherein a guide fork (43) which is approximately U-shaped in axial section is formed on the sensor housing (40) on its underside, which faces the carrier ring (35), this guide fork radially overlapping the pulse generator wheel (32) when the sensor housing (40) is fixed on the carrier ring (35), and wherein the sliding surfaces (41, 42) are arranged on the mutually facing inner surfaces of the guide fork (43).

20. The injection pump as claimed in claim 4, wherein a guide fork (43) which is approximately U-shaped in axial section is formed on the sensor housing (40) on its underside, which faces the carrier ring (35), this guide fork radially overlapping the pulse generator wheel (32) when the sensor housing (40) is fixed on the carrier ring (35), and wherein the sliding surfaces (41, 42) are arranged on the mutually facing inner surfaces of the guide fork (43).

21. The injection pump as claimed in claim 5, wherein a guide fork (43) which is approximately U-shaped in axial section is formed on the sensor housing (40) on its underside, which faces the carrier ring (35), this guide fork radially overlapping the pulse generator wheel (32) when the sensor housing (40) is fixed on the carrier ring (35), and wherein the sliding surfaces (41, 42) are arranged on the mutually facing inner surfaces of the guide fork (43).

22. The injection pump as claimed in claim 17, wherein the sliding surfaces (41, 42) are formed by the inner surfaces of the guide fork (43) themselves.

23. The injection pump as claimed in claim 1, wherein the sensor housing (40; 40'; 40") is produced in one piece and preferably from plastic.

24. The injection pump as claimed in claim 1, which comprises a coupling, arranged between the drive shaft (11) and the pump plunger (18), for converting the rotary driving motion of the drive shaft (11) into a reciprocating and simultaneously rotary motion of the pump plunger (18), the said coupling having a roller ring (22) which is rotatably mounted in the pump casing (10), coaxially with the drive shaft (11), and has radially aligned rollers (21) and having a face cam (17) which rolls on the said rollers by means of a cam track (20) and is connected firmly in terms of rotation to the pump plunger (18), which further comprises an injection adjuster (26) for the limited rotation of the roller ring (22), and wherein the carrier ring (35) is positively coupled to the roller ring (22).

25. The injection pump as claimed in claim 2, which comprises a coupling, arranged between the drive shaft (11) and the pump plunger (18), for converting the rotary driving motion of the drive shaft (11) into a reciprocating and simultaneously rotary motion of the pump plunger (18), the said coupling having a roller ring (22) which is rotatably mounted in the pump casing (10), coaxially with the drive shaft (11), and has radially aligned rollers (21) and having a face cam (17) which rolls on the said rollers by means of a cam track (20) and is connected firmly in terms of rotation to the pump plunger (18), which further comprises an injection adjuster (26) for the limited rotation of the roller ring (22), and wherein the carrier ring (35) is positively coupled to the roller ring (22).

26. The injection pump as claimed in claim 3, which comprises a coupling, arranged between the drive shaft (11) and the pump plunger (18), for converting the rotary driving motion of the drive shaft (11) into a reciprocating and simultaneously rotary motion of the pump plunger (18), the said coupling having a roller ring (22) which is rotatably mounted in the pump casing (10), coaxially with the drive shaft (11), and has radially aligned rollers (21) and having a face cam (17) which rolls on the said rollers by means of a cam track (20) and is connected firmly in terms of rotation to the pump plunger (18), which further comprises an injection adjuster (26) for the limited rotation of the roller ring (22), and wherein the carrier ring (35) is positively coupled to the roller ring (22).

27. The injection pump as claimed in claim 4, which comprises a coupling, arranged between the drive shaft (11) and the pump plunger (18), for converting the rotary driving motion of the drive shaft (11) into a reciprocating and simultaneously rotary motion of the pump plunger (18), the said coupling having a roller ring (22) which is rotatably mounted in the pump casing (10), coaxially with the drive shaft (11), and has radially aligned rollers (21) and having a face cam (17) which rolls on the said rollers by means of a cam track (20) and is connected firmly in terms of rotation to the pump plunger (18), which further comprises an injection adjuster (26) for the limited rotation of the roller ring (22), and wherein the carrier ring (35) is positively coupled to the roller ring (22).

28. The injection pump as claimed in claim 5, which comprises a coupling, arranged between the drive shaft (11) and the pump plunger (18), for converting the rotary driving motion of the drive shaft (11) into a reciprocating and simultaneously rotary motion of the pump plunger (18), the said coupling having a roller ring (22) which is rotatably mounted in the pump casing (10), coaxially with the drive shaft (11), and has radially aligned rollers (21) and having a face cam (17) which rolls on the said rollers by means of a cam track (20) and is connected firmly in terms of rotation to the pump plunger (18), which further comprises an injection adjuster (26) for the limited rotation of the roller ring (22), and wherein the carrier ring (35) is positively coupled to the roller ring (22).

* * * * *